US005486242A

United States Patent [19]

Naka et al.

[11] Patent Number: 5,486,242

[45] Date of Patent: Jan. 23, 1996

[54] NIOBIUM OR TANTALUM BASED HIGH SPECIFIC STRENGTH INTER METALLIC COMPOUNDS AND ALLOYS

[75] Inventors: Shigehisa Naka; Tasadduq Khan, both of Jouy-en-Josas; André Walder, L'Hay les Roses; Michel Marty, Buc; Christophe Delaunay, Paris; Pierre Thevenin, Evry, all of France

[73] Assignee: Office National d'Etudes et de Recherches Aerospatiales, Chatillon Cedex, France

[21] Appl. No.: 440,659

[22] Filed: May 15, 1995

Related U.S. Application Data

[63] Continuation of Ser. No. 340,446, Nov. 14, 1994, abandoned, which is a continuation of Ser. No. 50,245, filed as PCT/FR91/00905, Nov. 15, 1991, abandoned.

[30] Foreign Application Priority Data

Nov. 26, 1990 [FR] France ..... 90 14760

[51] Int. Cl.[6] ..... C22C 27/02

[52] U.S. Cl. ..... 148/422; 148/442; 420/426; 420/427; 420/580; 420/588

[58] Field of Search ..... 148/422, 442; 420/426, 427, 580, 588

[56] References Cited

U.S. PATENT DOCUMENTS 2,882,146 4/1959 Rhodin, Jr. ..... 420/426

3,022,163 2/1962 Lottridge, Jr. ..... 420/426

FOREIGN PATENT DOCUMENTS 1226437 9/1957 France .

*Primary Examiner*—David A. Simmons
*Assistant Examiner*—Robert R. Koehler
*Attorney, Agent, or Firm*—Armstrong, Westerman, Hattori, McLeland & Naughton

[57] ABSTRACT

Tantalum-based and niobium-based alloys made up entirely of a crystalline medium exhibiting a substantially continuous centered cubic structure, comprising an intermetallic compound of formula $Ti_2AlMo$, and having the following compositions on an atomic basis:

| | |
|---|---|
| Ta + Cr | 20 to 35% |
| Cr | 0 to 5% |
| Ti | 20 to 40% |
| Al | 8 to 20% |
| Mo | 8 to 20%, |

wherein the concentration of Ta is less than 30%; and

| | |
|---|---|
| Nb + Cr | 20 to 60% |
| Cr | 0 to 5% |
| Ti | 20 to 40% |
| Al | 8 to 20% |
| Mo | 8 to 20%. |

4 Claims, 3 Drawing Sheets

NIOBIUM OR TANTALUM BASED HIGH SPECIFIC STRENGTH INTER METALLIC COMPOUNDS AND ALLOYS

This application is a continuation of application Ser. No. 08/340,446 filed Nov. 14, 1994, now abandoned; which is a continuation of application Ser. No. 08/050,245 filed as PCT/FR91/00905, Nov. 15, 1991, abandoned.

Niobium alloys have begun to be employed for high-temperature applications in the aeronautics field, because of their refractory nature and, above all, their relatively low relative density (8.6 in the case of unalloyed niobium), compared with that of the other refractory alloys based on tantalum, molybdenum or tungsten. However, the problems to be solved are numerous, for example their poor resistance to oxidation and their mediocre mechanical strength at low and intermediate temperature (25°–900° C).

It is known to improve the mechanical characteristics of nickel alloys in this temperature range by incorporating aluminum therein, which results in the formation of an intermetallic compound $Ni_3AL$. This compound precipitates in the form of a phase called $\gamma'$ compatible with the $\gamma$ phase of the nickel matrix, that is to say that the two phases have the same crystal structure (face-centered cubic) and closely related crystallographic constants, and form a crystalline medium which does not exhibit abrupt discontinuities liable to result in brittleness of the alloy.

Aluminum also forms with niobium an intermetallic compound $Nb_3Al$, but the latter has a complex crystal structure, different from the centered cubic structure of niobium and incompatible with the latter, and this would therefore be detrimental to the ductility of the alloy. Known niobium alloys are therefore all in the form of solid solutions, and therefore single-phrase, except that in some cases a second phase of the carbide type is present, which does not contribute an effective hardening at high temperature.

The inventors have applied themselves to investigating niobium alloys containing a high volume fraction of a second intermetallic phase. The approach adopted consists in incorporating into the alloys a second phase which is crystallographically simple and, if possible, compatible with the niobium matrix, this being so as to make it possible to increase the mechanical strength over a wide range of temperatures while retaining the ductility of these alloys when cold. Since niobium has the centered cubic crystallographic structure of type A1, the second phase must therefore have, for example, a crystallographic structure of type B2. This latter structure differs from the preceding one in the distribution of the atoms according to a certain order between two types of sites consisting, on the one hand, of the four apexes of a cube and, on the other hand, of the center of this cube.

However, an extensive literature study carried out by the inventors shows the absence of binary B2 phase consisting of niobium and a second element.

According to the literature the ternary compounds $Ti_2AlX$ (X=Mo, Cr, Fe, Nb) have the B2 structure; the crystallographic constants are not well known but appear to be of the order of 3.15 Å (the niobium constant is 3.3 Å.

Figure 1:
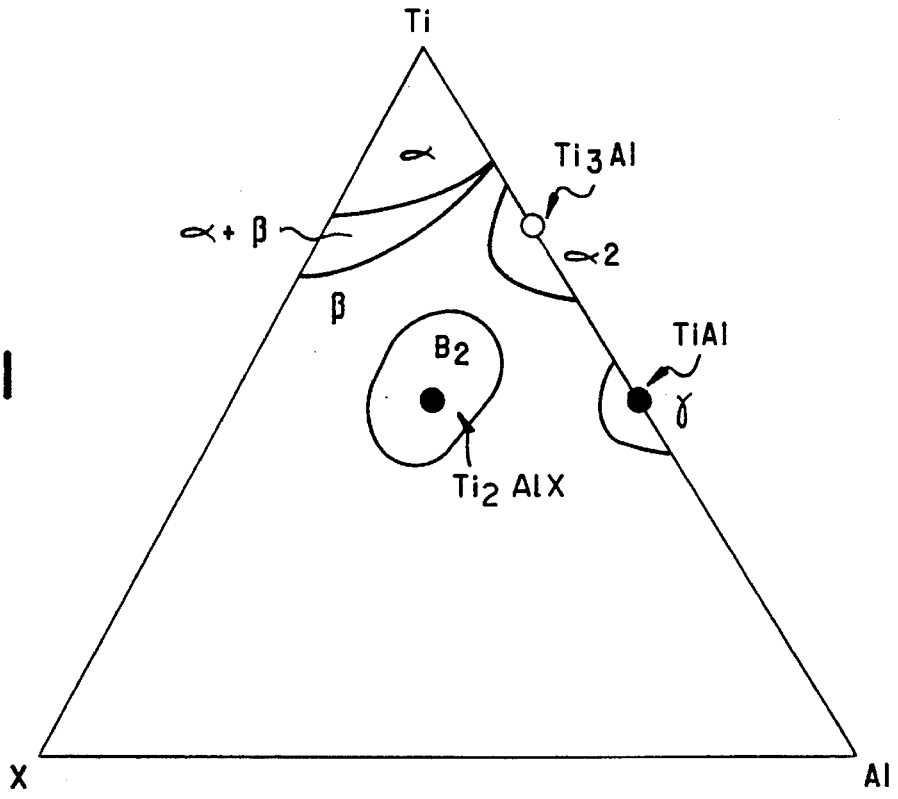
FIG. 1 represents a Ti-Al-X ternary phase diagram.

The inventors have shown that this phase exists in a relatively extended domain around the theoretical composition $Ti_2AlX$, as shown in FIG. 1, which shows a ternary diagram Ti-Al-X. The stability of this phase depends, however, on the element X. In the case of the composition $Ti_2AlNb$, for example, the B2 phase which exists alone at high temperature decomposes at low temperature: the equilibrium state is two-phase of the type $\alpha_2$(=$Ti_3Al$)+B2. This decomposition is kinetically slow and there is a risk that transition phases will appear, such as the $\omega$ phase which is highly detrimental to ductility. In the case of the composition $Ti_2AlMo$, on the other hand, the B2 phase is always stable, but this alloy is brittle.

Figure 2:
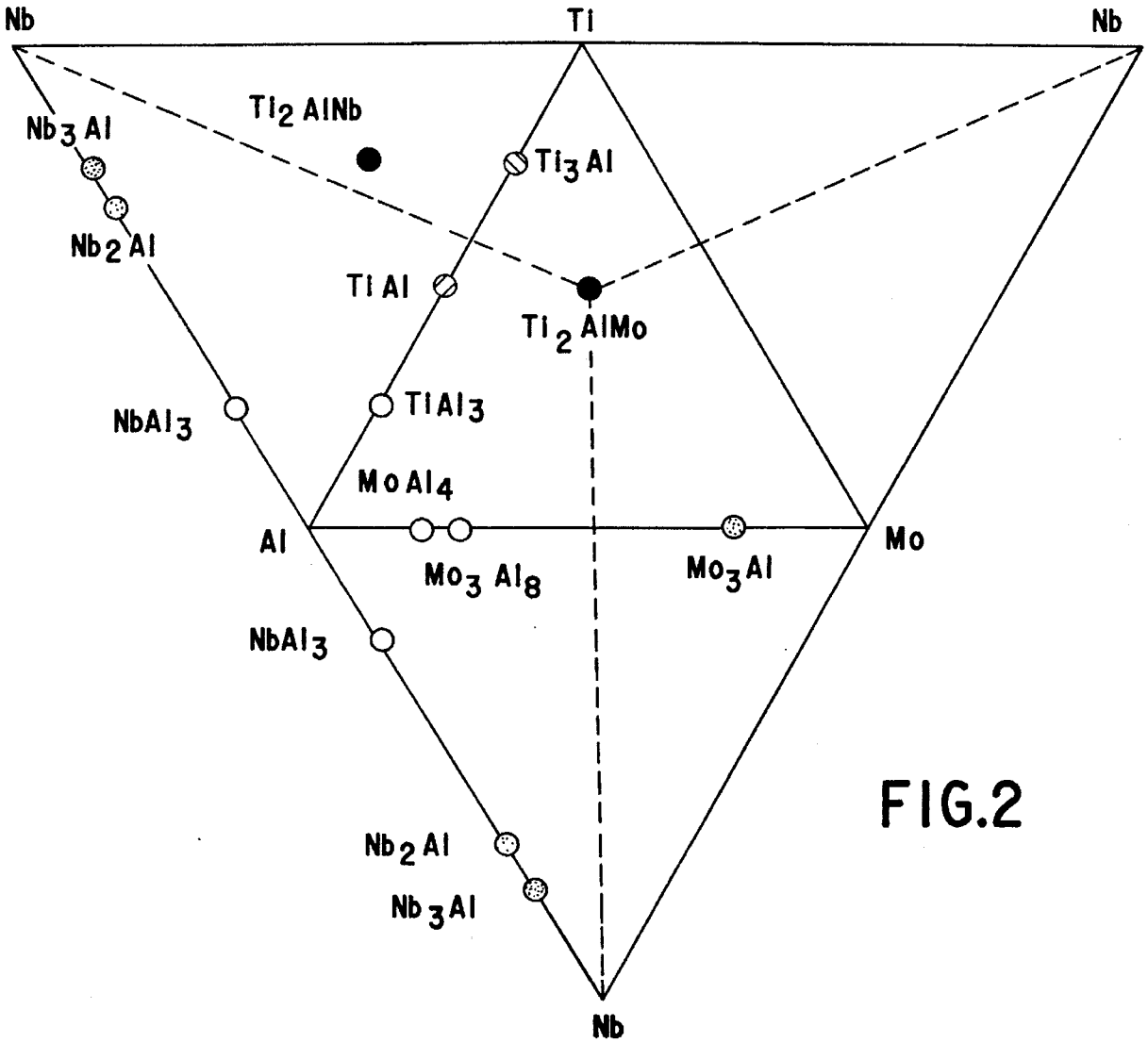
FIG. 2 represents ternary phase diagrams for Ti-Mo-Al, Nb-Mo-Ti, Nb-Al-Mo, and Nb-Ti-Al.

Niobium, $\beta$ titanium and molybdenum are completely miscible with each other, whereas the solubility of aluminum in niobium, in titanium and in molybdenum is limited to about 10% on an atomic basis. In the Nb-Al system, three phases are found: $Nb_3Al$ (cubic Al5), $Nb_2Al$ (tetragonal $D8_b$) and $NbAl_3$, (tetragonal $DO_{22}$); in the Ti-Al system, $Ti_3Al$ (hexagonal $DO_{19}$) , TiAl (tetragonal $Ll_0$) , $TiAl_3$ ($DO_{22}$), and the like; in the Mo-Al system, $Mo_3Al$ (Al5), $Mo_3Al_8$ (monoclinic), $MoAl_4$, and the like. All these phases are marked in a diagram (FIG. 2) comprising four ternary systems, Ti-Mo-Al in the middle and Nb-Mo-Ti, Nb-Al-Mo, Nb-Ti-Al outside. These four triangles correspond to the four faces of a tetrahedron representing the Nb-Ti-Al-Mo system. The Nb-$Ti_2AlMo$ system is shown in the figure by lines joining Nb and $Ti_2MoAl$.

The subject of the invention is an alloy containing at least one refractory metal crystallizing in the centered cubic system, such as niobium or tantalum, this alloy being made up entirely of a crystalline medium exhibiting a substantially continuous centered cubic structure, characterized in that it comprises an intermetallic compound of formula $Ti_2AlX$, X denoting one or more metals, the atomic concentration of the titanium in the alloy being at least 16% and that of the said refractory metals being at least 15%, and in that it contains at least one element other than Ti, Al, Nb and Ta.

According to one embodiment of the invention the alloy is in the form of a solid solution of $Ti_2AlX$, of niobium and, if appropriate, of additional elements capable of forming binary solid solutions with niobium, and X is predominantly molybdenum, $Ti_2AlX$ representing 40 to 80% of the alloy on an atomic basis.

Advantageously, the alloy according to this first embodiment contains chromium associated with niobium, in a concentration not exceeding 5% on an atomic basis.

According to a second embodiment of the invention the alloy consists of the compound $Ti_2AlX$, X being predominantly niobium and/or tantalum and additionally including at least one transition element used to stabilize the B2 phase of the said compound, especially molybdenum and/or chromium.

According to a third embodiment of the invention the alloy comprises the compound $Ti_2AlNb$, representing at least 60% of the alloy on an atomic basis, as well as molybdenum and, if appropriate, additional elements such as tungsten and/or chromium.

According to a fourth embodiment of the invention the alloy contains tantalum in a concentration which is lower than 30% on an atomic basis, X being predominantly molybdenum.

Other characteristics and advantages of the invention will emerge from the detailed description given below and from the attached drawings.

EXAMPLES 1 TO 3

Three alloys which have the compositions shown in the table below were produced. This table shows the percentage, on an atomic basis, of each constituent element and, below that, the corresponding percentage on a mass basis.

| | Nb | Ti | Al | Mo | Cr | Relative density |
|---|---|---|---|---|---|---|
| 1 | 55 | 20 | 10 | 10 | 5 | 7.3 |
| | 67.6 | 12.7 | 3.6 | 12.7 | 3.4 | |
| 2 | 37 | 30 | 15 | 15 | 3 | 6.7 |
| | 50.0 | 20.9 | 5.9 | 20.9 | 2.3 | |
| 3 | 30 | 34 | 17 | 17 | 2 | 6.4 |
| | 42.2 | 24.6 | 6.9 | 24.7 | 1.6 | |

In these alloys the ratios of Ti, Al and Mo correspond exactly to the formula $Ti_2AlMo$, and the ratio (Nb+Cr)/(Ti+Al+Mo) varies from 3/2 to 8/17.

Figure 3:
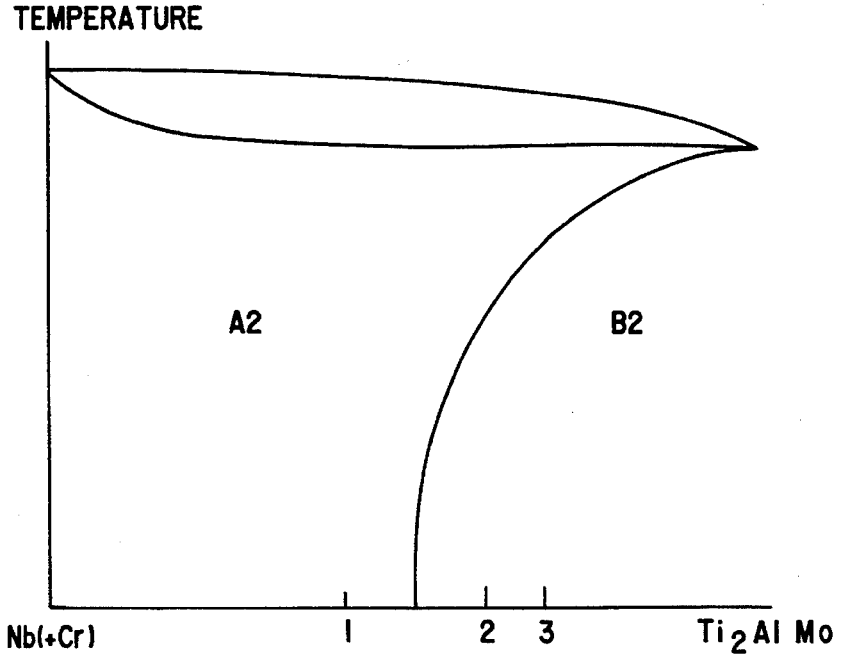
FIG. 3 is a qualitative equilibrium diagram for the system Nb(+Cr)-$Ti_2AlMo$.

The microstructural study performed on these alloys has made it possible to establish a qualitative Nb(+Cr)—$Ti_2AlMo$ pseudo-binary equilibrium diagram, shown diagrammatically in FIG. 3. In the crude state as produced the alloy of Example 1 is single-phase and has the disordered centered cubic structure (A2), while alloys 2 and 3 are also single-phase and have the ordered centered cubic structure (B2) as is the case with the alloy $Ti_2AlMo$. Moreover, the alloys of Examples 2 and 3 are stable at least up to 1000° C., retaining their ordered B2 structure. The diagram relates to alloys which, besides Nb, Ti, Al and Mo, may contain chromium in a concentration not exceeding 5% on an atomic basis.

Figure 4:
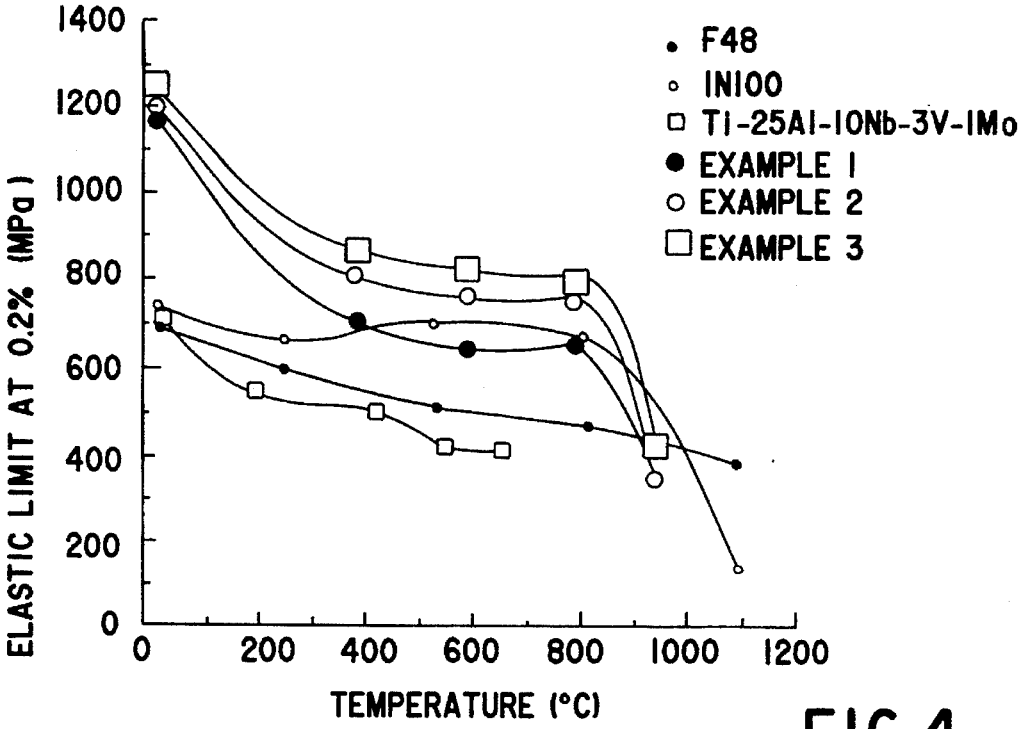
FIGS. 4 and 5 are graphs showing the change in mechanical properties of different alloys as a function of temperature.

The elastic limits of these alloys are shown in FIG. 4 as a function of temperature. By way of comparison, the elastic limits of three alloys of different categories are plotted in the same figure (F-48: conventional niobium alloy; IN100, nickel-based superalloy; Super $\alpha_2$: titanium aluminide Ti-25Al-10Nb-3V-1Mo). The three alloys of the present invention have an elastic limit of the order of 1200 MPa at 25° C. and this is maintained at a level between 650 MPa and 900 MPa up to approximately 800° C. before falling to approximately 400 MPa at 950° C. Up to approximately 900° C., these alloys therefore offer mechanical characteristics which are superior to or comparable with those of the alloy IN100, which is a superalloy widely employed for vanes and disks of present aircraft engines.

Figure 5:
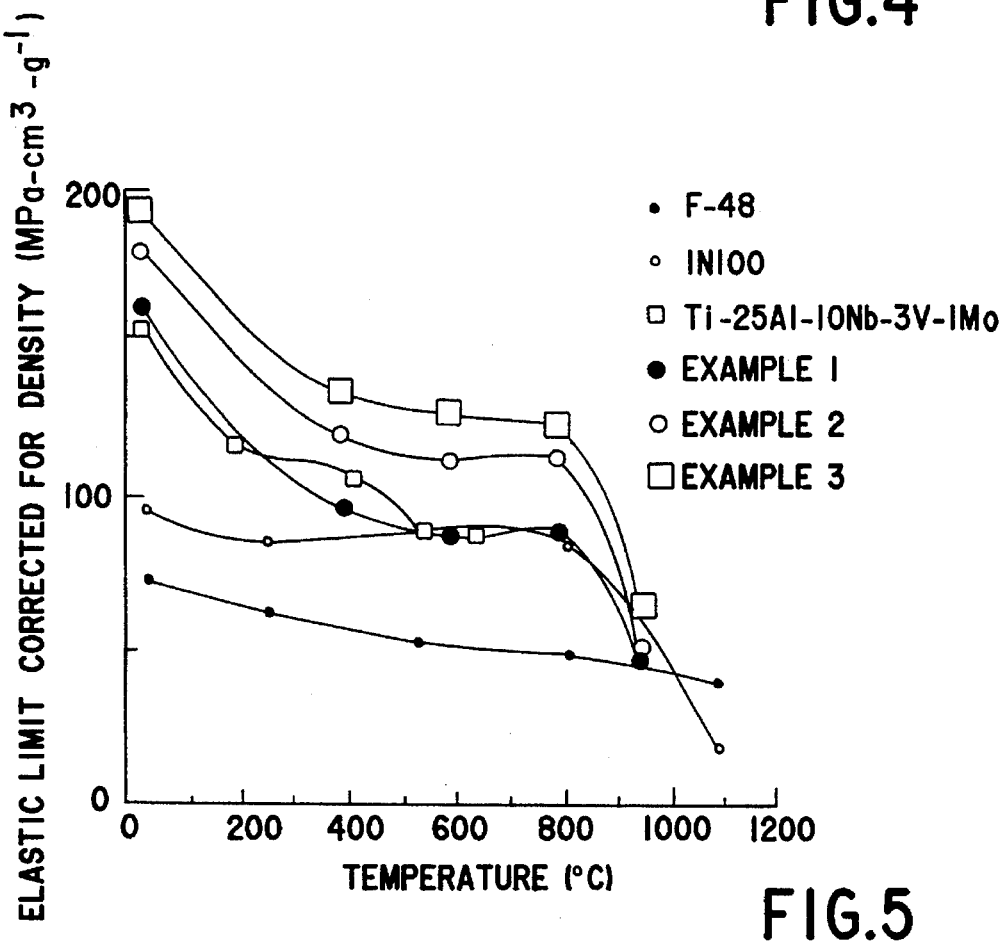

The three alloys according to the present invention have a low relative density of between 6.4 and 7.3 (see Table), while the nickel-based superalloys have a density which is frequently very markedly higher than 8. The same comparisons as in FIG. 4 have been made in FIG. 5, the elastic limit being corrected for the density. The values of the specific elastic limit (results of the correction) demonstrate still more clearly the advantage of the alloys of the invention over the others up to approximately 950° C. It should be noted that the alloy Super $\alpha_2$, very advantageous because of its very low relative density (4.7), has an elastic limit which falls rapidly above 650° C. The alloys according to the invention thus easily outclass the alloy Super $\alpha_2$ from the viewpoint of the working temperature and of mechanical strength.

The alloys of Examples 1 to 3, which correspond to the first embodiment of the invention, surprisingly comprise a single phase, of A2 or B2 type depending on the niobium and chromium concentrations, whereas they were expected to exhibit at the same time phases of both types, compatible with each other.

This probably remains true within the following composition domain on an atomic basis:

| | |
|---|---|
| Nb + Cr | 20 to 60% |
| Cr | 0 to 5% |
| Ti | 20 to 40% |
| Mo | 8 to 20% |
| Al | 8 to 20% |

the ratio Ti:Ai:Mo remaining close to 2:1:1.

Nevertheless, it is not ruled out that in the same single alloy according to the invention two compatible phases of the A2 and B2 types may be obtained either by replacing, in the first embodiment, a proportion of the molybdenum with other elements such as chromium and/or tungsten, or in the other embodiments. The essential point is that the alloys according to the invention do not give rise to the formation of phases which are incompatible with the centered cubic structures of niobium and of the compound $Ti_2AlX$.

The advantages of the present invention, according to its second embodiment, are also obtained with alloys consisting entirely of the compound $Ti_2AlX$, X being predominantly niobium and additionally comprising at least one transition element such as molybdenumand/or chromium which is used to stabilize the B2 phase and thus avoids the appearance of detrimental phases such as the ω phase which is observed in the case of the compound $Ti_2AlNb$. The concentration of niobium on an atomic basis is then lower than 25%. The niobium can be replaced partially or even completely with tantalum without the density of the alloy becoming prohibitive.

In the third embodiment of the invention, molybdenum and, if appropriate, additional elements such as tungsten and/or chromium are added in order to stabilize the B2 phase of the compound $Ti_2AlNb$, instead of replacing a proportion of the niobiumtherein with other elements. The content of these added elements is limited to 40% on an atomic basis in order to remain in the domain of the B2 ordered phase and to retain a low density of the alloy.

Finally, the fourth embodiment of the invention differs from the first in that the niobium is replaced with tantalum. In this case the tantalum content must be lower than 30% on an atomic basis for the density of the alloys to remain relatively low. The latter reaches the value of 9 in the case of an alloy containing 30% of tantalum, with X=Mo. Such alloys exhibit excellent mechanical properties when hot.

What is claimed is:

1. Niobium-based alloy made up entirely of a crystalline medium exhibiting a substantially continuous centered cubic structure, comprising an intermetallic compound of formula $Ti_2AlMo$, and having a composition on an atomic basis in the following domain:

| | |
|---|---|
| Nb + Cr | 20 to 40% |
| Cr | 0 to 5% |
| Ti | 30 to 40% |
| Al | 15 to 20% |
| Mo | 15 to 20%, |

the ratio Ti:Al:Mo being approximately 2:1:1, and the concentration of Nb being not more than 37%.

2. Tantalum-based alloy made up entirely of a crystalline medium exhibiting a substantially continuous centered cubic structure, comprising Ta, Cr, Ti, Al and Mo, wherein the concentrations of Ta and Cr on an atomic basis are:

| | |
|---|---|
| Ta | 15 to less than 30%, |
| Cr | 0 to 5%, |

the balance consisting essentially of Ti, Al and Mo in an atomic ratio Ti:Al:Mo of approximately 2:1:1, wherein Ti, Al and Mo are present in the alloy in the form of an intermetallic compound of formula $Ti_2Al$ Mo in an amount which does not exceed 80% of the alloy on an atomic basis.

3. Niobium-based alloy made up entirely of a crystalline medium exhibiting a substantially continuous centered cubic structure, comprising an intermetallic compound of formula $Ti_2AlMo$, and having the composition:

| | |
|---|---|
| Nb | 37% |
| Ti | 30% |
| Al | 15% |
| Mo | 15% |

-continued

| | |
|---|---|
| Cr | 3%, |

and being in the form of a single phase which has a crystallographic structure of type B2 at ambient temperature.

4. Niobium-based alloy made up entirely of a crystalline medium exhibiting a substantially continuous centered cubic structure, comprising an intermetallic compound of formula $Ti_2AlMo$, and having the composition:

| | |
|---|---|
| Nb | 30% |
| Ti | 34% |
| Al | 17% |
| Mo | 17% |
| Cr | 2%, |

and being in the form of a single phase which has a crystallographic structure of type B2 at ambient temperature.

* * * * *